US010792803B1

(12) United States Patent
Kao

(10) Patent No.: US 10,792,803 B1
(45) Date of Patent: Oct. 6, 2020

(54) TOOL HOLDING FRAME

(71) Applicant: Jui Chien Kao, Taichung (TW)

(72) Inventor: Jui Chien Kao, Taichung (TW)

( * ) Notice: Subject to any disclaimer, the term of this patent is extended or adjusted under 35 U.S.C. 154(b) by 28 days.

(21) Appl. No.: 16/405,161

(22) Filed: May 7, 2019

(51) Int. Cl.
*B25H 3/00* (2006.01)

(52) U.S. Cl.
CPC ..... *B25H 3/003* (2013.01)

(58) Field of Classification Search
CPC ..... B25H 3/04; B25H 3/06; B25H 3/003
USPC ..... 206/378, 376, 372, 373, 349; 211/70.6, 211/94.01
See application file for complete search history.

(56) References Cited

U.S. PATENT DOCUMENTS 7,841,480 B2 * 11/2010 Hsieh ..... B25H 3/06 211/70.6
9,186,790 B1 * 11/2015 Kao ..... B25H 3/06
9,538,862 B2 * 1/2017 Kao ..... A47F 5/08
9,539,721 B1 * 1/2017 Kao ..... B25H 3/003
9,662,781 B1 * 5/2017 Kao ..... B25H 3/003
9,694,491 B1 * 7/2017 Kao ..... B25H 3/04
9,821,451 B1 * 11/2017 Kao ..... B25H 3/04
9,878,441 B1 * 1/2018 Kao ..... B25H 3/003
D812,444 S * 3/2018 Kao ..... D8/71
D813,637 S * 3/2018 Kao ..... D8/71
9,914,207 B2 * 3/2018 Kao ..... B25H 3/04
9,956,681 B2 * 5/2018 Kao ..... B25H 3/003
10,022,857 B2 * 7/2018 Kao ..... B25H 3/003
D847,615 S * 5/2019 Kao ..... D8/366
10,421,175 B2 * 9/2019 Chou ..... B25B 13/06
2016/0096264 A1 * 4/2016 Kao ..... B25H 3/003 206/378
2018/0236653 A1 * 8/2018 Kao ..... B25H 3/006

* cited by examiner

*Primary Examiner* — Chun Hoi Cheung
(74) *Attorney, Agent, or Firm* — Birch, Stewart, Kolasch & Birch, LLP

(57) ABSTRACT

A tool holding frame has a track base, a positioning board, and at least one positioning mount. The positioning board is disposed on the track base and has a positioning segment. The first positioning segment has multiple positioning blocks having curved side edges and multiple positioning portions. The at least one positioning mount is slidably and rotatably mounted on the track base. Each positioning mount has an annular positioning flange and a second positioning segment. The second positioning segment is selectively engaged with two of the positioning portions.

14 Claims, 11 Drawing Sheets

TOOL HOLDING FRAME

BACKGROUND OF THE INVENTION

1. Field of the Invention

The present invention relates to a tool holding frame, and more particularly to a tool holding frame that may provide a firm positioning effect in rotation and in dual-movement directions to tools that are mounted on the tool holding frame.

2. Description of Related Art

With reference to FIG. 9, a conventional socket holding frame has a track base, a positioning board, and multiple positioning mounts. The track base is elongated. The positioning board is mounted on the track base and has multiple first engaging segments formed on the positioning board and arranged in a line. The positioning mounts are mounted slidably on the track base, and each positioning mount has multiple second engaging segments formed on a bottom of the positioning mount, arranged annularly, and selectively engaged with the first engaging segments on the positioning board. Accordingly, multiple sockets in different sizes can be respectively mounted around and positioned on the positioning mounts. With the engagement between the first and second engaging segments, the positioning mounts can be positioned at specific positions and angles relative to the track base, respectively. When one of the sockets or the positioning mounts is rotated, the label referring to the size of the socket can be rotated to a specific direction to allow a user to check the label easily. The first engaging segments of the conventional socket holding frame comprise multiple curved grooves arranged at spaced intervals and multiple ribs formed between the curved grooves. The second engaging segments comprises multiple teeth arranged annularly. With the engagements between the teeth and the ribs, the positioning mounts can be held at specific angles relative to the track base, respectively.

However, the first and second engaging segments of the conventional socket holding frame cannot provide a sufficient positioning effect to the positioning mounts along the movement direction. Although the curved grooves in the positioning board can provide a positioning effect to the positioning mounts, the curved grooves can only provide a positioning effect along one single movement direction and cannot provide a dual-directional movement positioning effect to the positioning mounts.

With reference to FIG. 10, the first engaging segments of another conventional socket holding frame comprise multiple grooves arranged in a line at spaced intervals and multiple ribs formed respectively on bottoms of the curved grooves. The second engaging segments comprise multiple teeth arranged annularly. With the engagements between the ribs and the teeth, the positioning mounts can be held at specific angles relative to the track base, respectively.

However, the curved grooves can only provide the positioning mounts with a unidirectional movement positioning effect, so the positioning effect provided by the engaging segments to the positioning mounts is not sufficient. The positioning mounts are easily moved relative to the track base when a force is applied to the socket holding frame.

With reference to FIG. 11, the first engaging segment of further another conventional socket holding frame comprises a rib extending longitudinally along the positioning board. With the engagement of the rib and the teeth of the second positioning segments of the positioning mounts, the positioning mounts can be held at specific angles relative to the track base, respectively.

However, engaging segments of the conventional socket holding frame can only provide the positioning mounts with a positioning effect to rotation and cannot provide a positioning effect to the positioning mounts with a positioning effect of movement. Therefore, the positioning mounts are easily moved relative to the track base when a force is applied to the socket holding frame.

To overcome the shortcomings of the conventional socket holding frame, the present invention provides a tool holding frame to mitigate or obviate the aforementioned problems.

SUMMARY OF THE INVENTION

The main objective of the present invention is to provide a tool holding frame that can provide a firm positioning effect in dual-movement directions and rotation to tools that are mounted on the tool holding frame.

The tool holding frame has a track base, a positioning board, and at least one positioning mount. The track base is an elongated seat and has two sliding channels defined respectively in two sides of the track base. Each rail has an opening, and the openings of the two sliding channels face each other. The positioning board is disposed on the track base and has a top surface and a first positioning segment. The first positioning segment is formed on the top surface of the positioning board and has multiple positioning blocks and multiple positioning portions. The positioning blocks are formed on and protrude from the top surface of the positioning board and arranged in a line at spaced intervals to define multiple positioning recesses respectively between the positioning blocks. Each positioning block has two curved side edges formed on two opposite sides of the positioning block. The positioning portions are formed on and protrude from the top surface of the positioning board and are held respectively in the positioning recesses. The at least one positioning mount is slidably and rotatably mounted on the track base. Each one of the at least one positioning mount has a sliding seat and an extending element. The sliding seat is slidably and rotatably mounted in the sliding channels of the rails and has a bottom, a top, an annular positioning flange, and a second positioning segment. The annular positioning flange is formed on and protrudes downwardly from the bottom of the sliding seat, is selectively engaged with two of the positioning recesses in the positioning board. The second positioning segment is formed on the bottom of the positioning flange and is selectively engaged with two positioning portions held in the two positioning recesses engaged with the positioning flange. The extending element is formed on and protrudes upwardly from the top of the sliding seat.

Other objects, advantages, and novel features of the invention will become more apparent from the following detailed description when taken in conjunction with the accompanying drawings.

DETAILED DESCRIPTION OF PREFERRED EMBODIMENT

Figure 1:
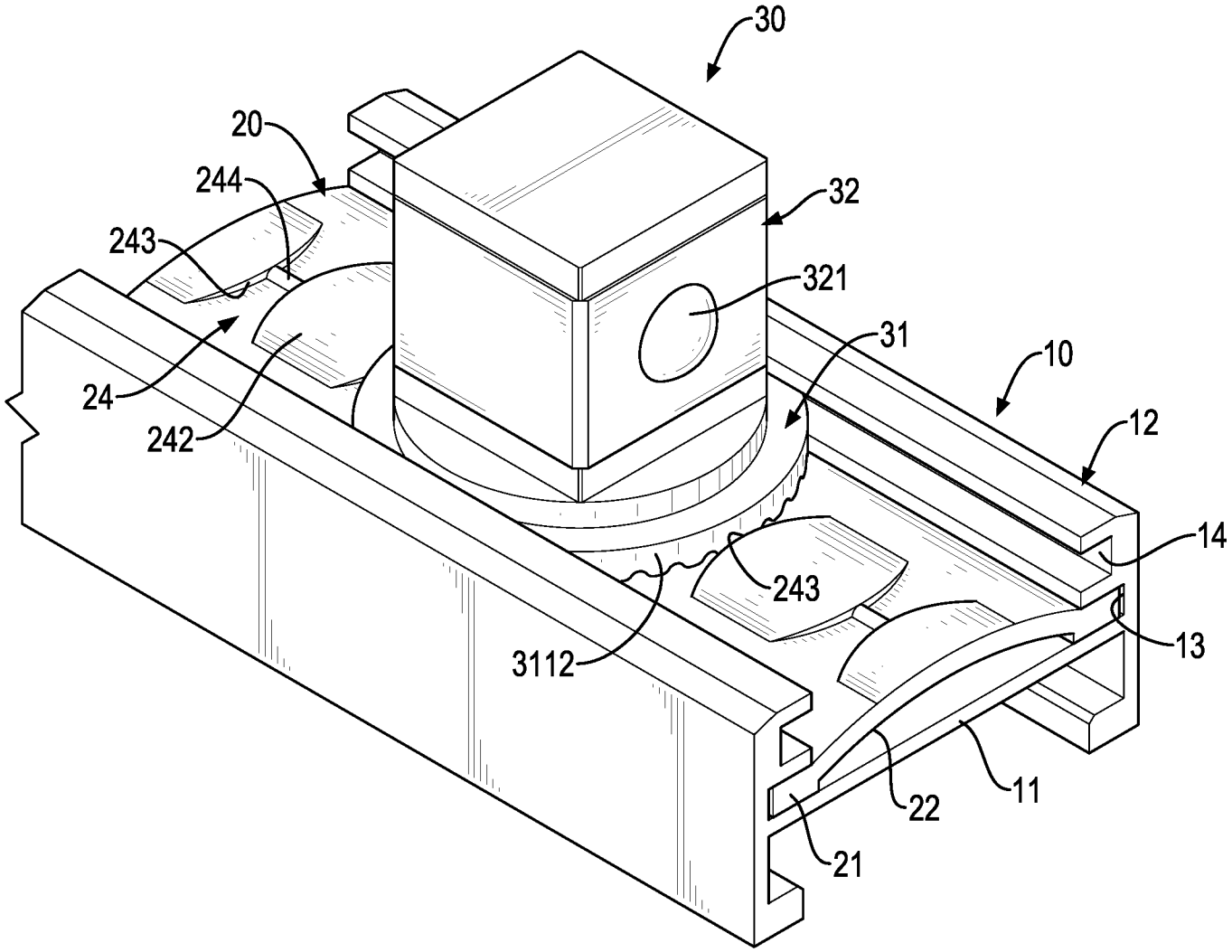
FIG. 1 is a partial perspective view of a tool holding frame in accordance with the present invention.
Figure 2:
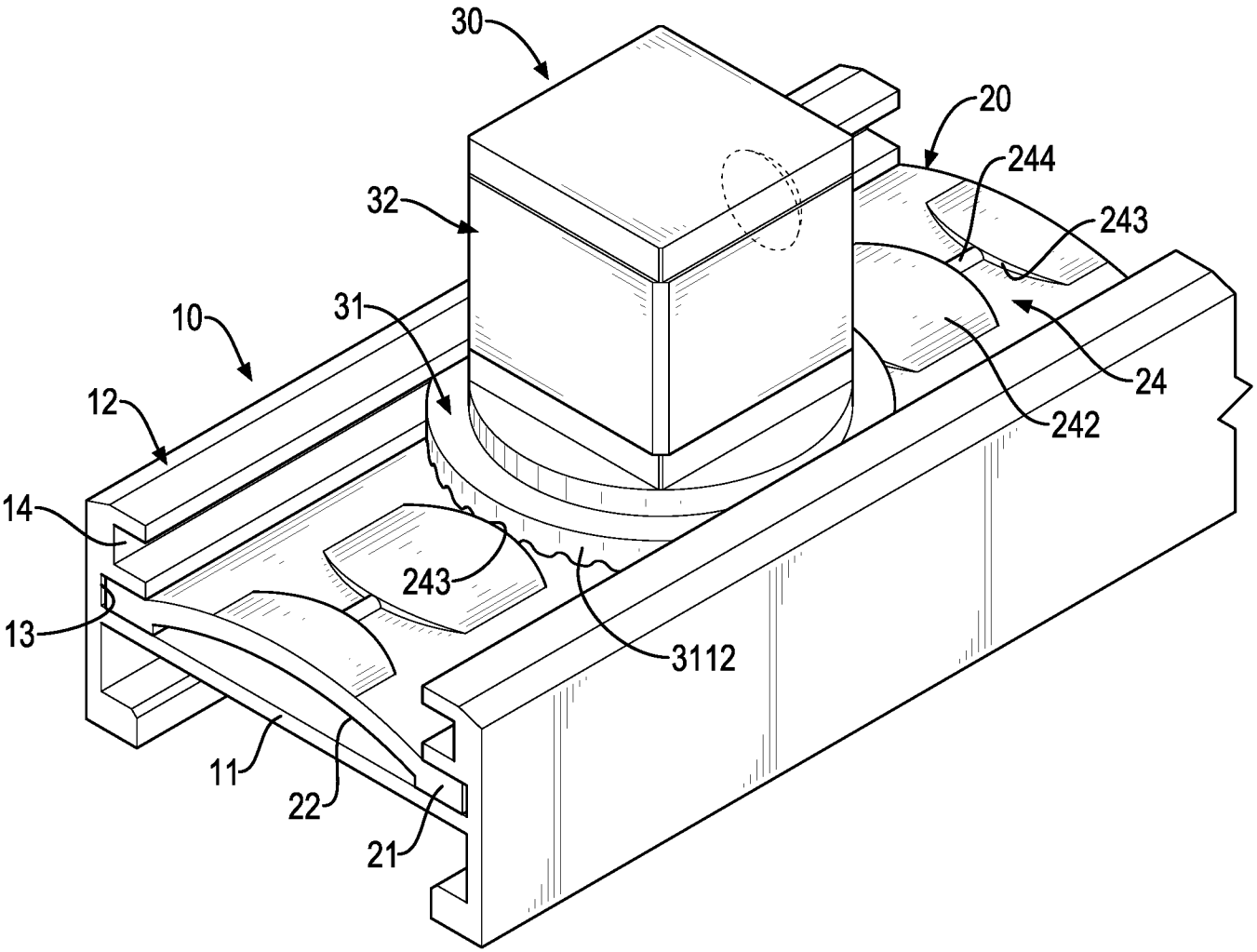
FIG. 2 is another partial perspective view of the tool holding frame in FIG. 1.
Figure 3:
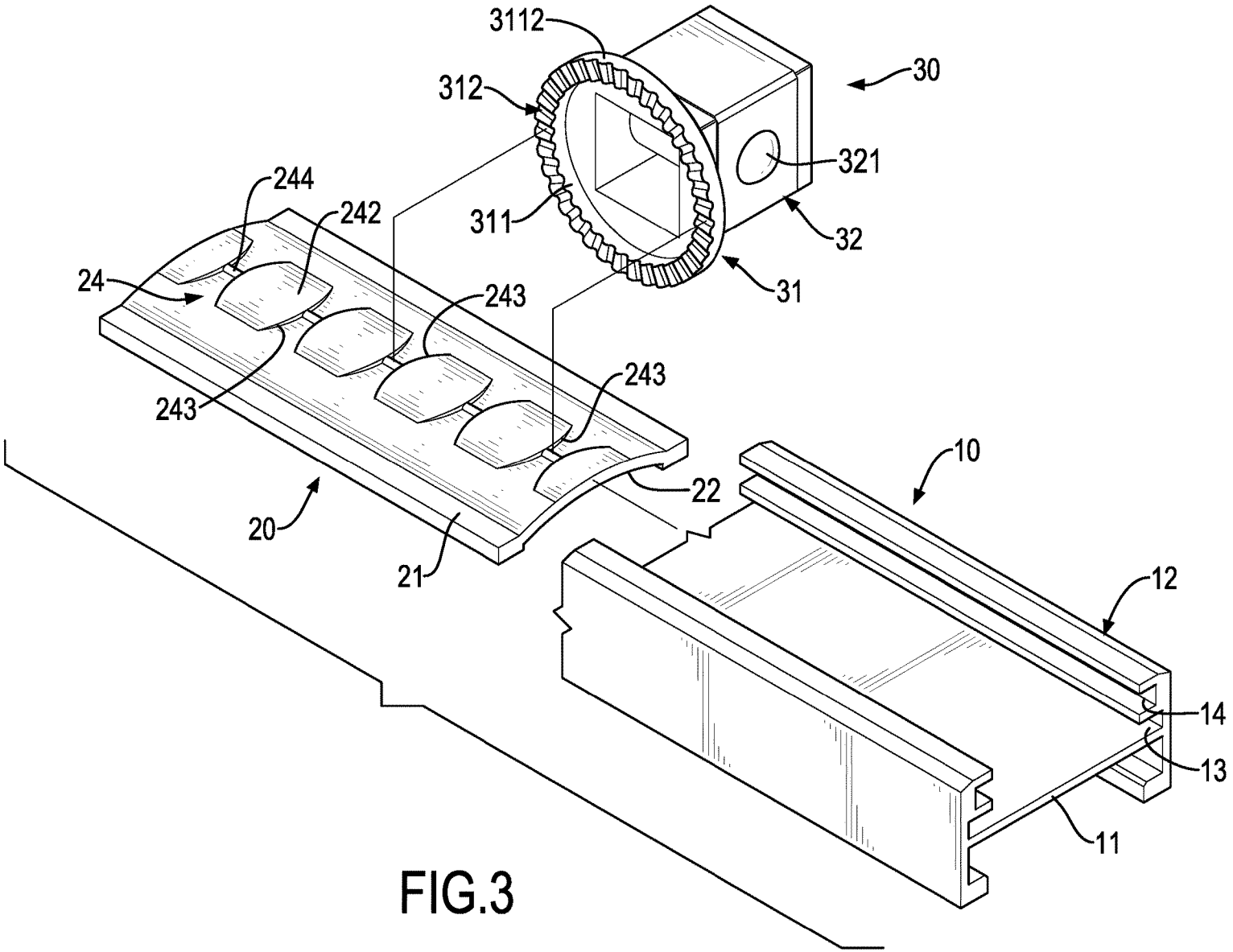
FIG. 3 is an enlarged exploded perspective view of the tool holding frame in FIG. 1.
Figure 4:
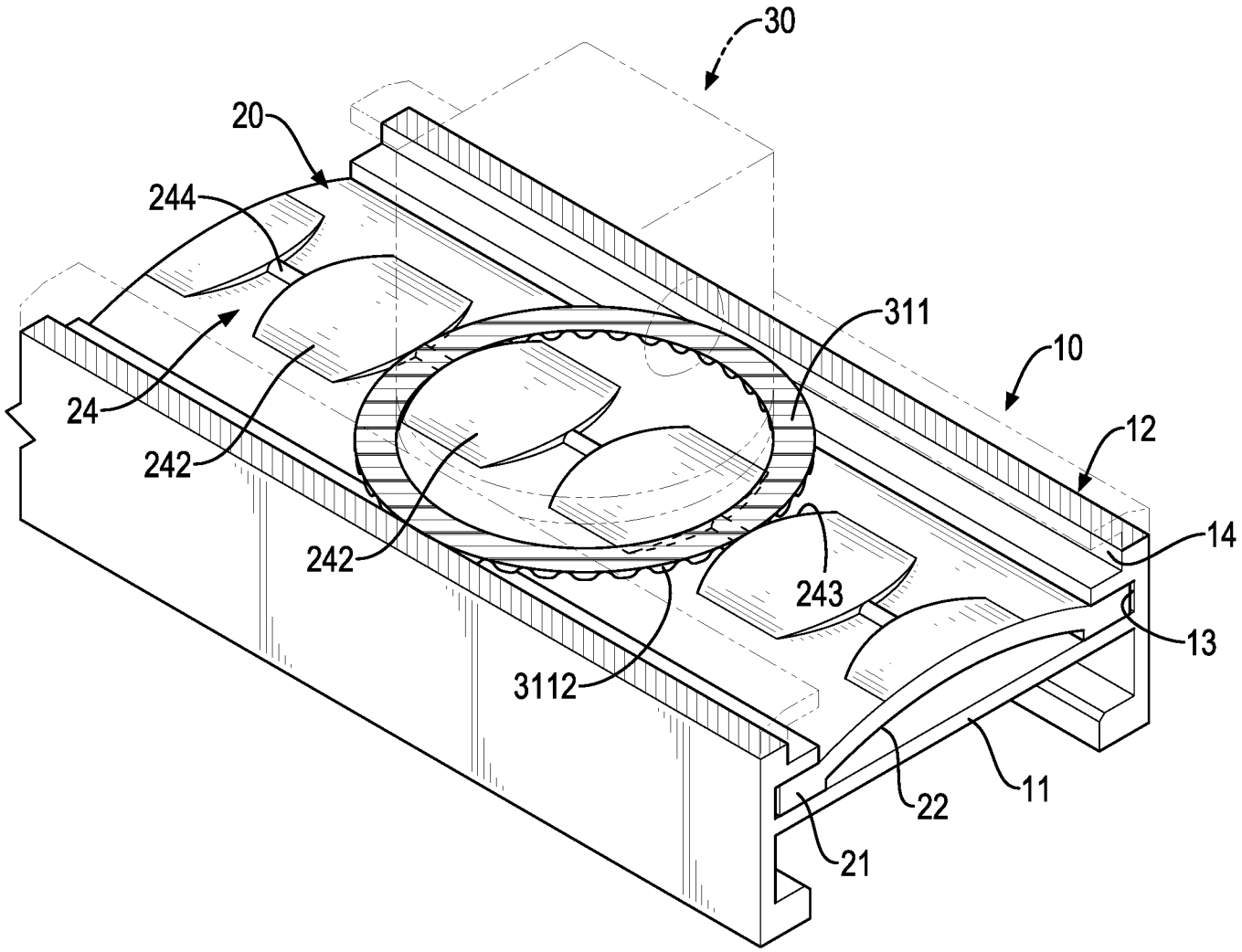
FIG. 4 is a partial perspective view in partial section of the tool holding frame in FIG. 1.

With reference to FIGS. 1 to 3, a tool holding frame in accordance with the present invention comprises a track base 10, a positioning board 20, and at least one positioning mount 30.

The track base 10 is elongated, is made of metal, and is preferably an aluminum extrusion. The track base 10 comprises a bottom panel 11 and two rails 12. The bottom panel 11 is elongated. The two rails 12 are respectively formed on and protrude from two sides of the bottom panel 11. Each rail 12 has a sliding channel 14 and a positioning channel 13. Each one of the sliding channels 14 and the positioning channels 13 has an opening. The openings of the sliding channels 14 face each other and the openings of the positioning channels 13 also face each other. The positioning channel 13 of each rail 12 is located below the sliding channel 14 of the rail 12.

The positioning board 20 is mounted on the track base 10 between the rails 12. Preferably, the positioning board 20 is resilient and is mounted in the positioning channels 13 in the rails 12 of the track base 10. Alternatively, the positioning board 20 may be connected integrally with the rails 12 and is served as the bottom panel 11 of the track base 10. In a first embodiment, the positioning board 20 has two long opposite sides, two free ends, a middle, a top surface, a bottom surface, two rail bars 21, a recess 22, and a positioning segment 24. The positioning board 20 is bent upwardly from the long opposite sides to the middle of the positioning board 20. The two rail bars 21 are formed on and protrude outwardly from the bottom surface of the positioning board 20 respectively at the two long opposite sides of the positioning board 20 and are mounted respectively in the positioning channels 13 of the rails 12. Alternatively, the rail bars 21 are connected integrally with the rails 12 respectively. The recess 22 is formed in the bottom surface at the middle of the positioning board 20 between the free ends of the positioning board 20, and is parallel with the long opposite sides of the positioning board 20, such that the cross section of the positioning board 20 is curved to allow the middle of the positioning board 20 to deform relative to the track base 10.

The positioning segment 24 is formed on the top surface and the middle of the positioning board 20 between the two free ends of the positioning board 20. The positioning segment 24 comprises multiple positioning blocks 242 and positioning portions 244. The positioning blocks 242 are formed on and protrude from the top surface of the positioning board 20 and are arranged in a line at spaced intervals to define multiple positioning recesses respectively between the positioning blocks 242. Each positioning block 242 has two curved side edges 243 formed on two opposite sides of the positioning block 242. The positioning portions 244 are formed on and protrude from the top surface of the positioning board 20 and are held respectively in the positioning recesses. Preferably, each portion 244 is a rib and has two ends connected respectively with two curved side edges 243 of two adjacent positioning blocks 242.

The at least one positioning mount 30 is slidably and rotatably mounted on the track base 10, and each one of the at least one positioning mount 30 has a sliding seat 31 and an extending element 32. The sliding seat 31 is round and resilient and is slidably and rotatably mounted in the sliding channels 14 in the rails 12. The sliding seat 31 has a bottom, a top, an annular positioning flange 311, and a second positioning segment 312. The annular positioning flange 311 is formed on and protrudes downwardly from the bottom of the sliding seat 31 and is selectively engaged with two of the positioning recesses in the positioning board 20. The second positioning segment 312 is formed on and protrudes from the bottom of the sliding seat 31 and comprises multiple teeth formed on and protruding from the bottom of the positioning flange 311 of the positioning mount 30 and arranged annularly at spaced intervals. Accordingly, the second positioning segment 312 is waved in shape, and adjacent two of the teeth of the second positioning segment 312 are selectively engaged with one of the positioning portions 244.

The extending element 32 is formed on and protrudes upwardly from the top of the sliding seat 31. The extending element 32 is hollow, is rectangular, and has a side surface and a protruding ball 321. The protruding ball 321 is mounted in and extends outwardly from the side surface of the extending element 32.

With reference to FIGS. 4 to 7, to dispose the positioning mount 30 onto the track base 10, the sliding seat 31 of the positioning mount 30 is inserted into the sliding channels 14 in the rails 12 from one of the ends of the track base 10. Consequently, the positioning mount 30 is slid to a desired position on the track base 10. At this time, the annular positioning flange 311 is engaged with two of the positioning recesses in the positioning boards 20, and four teeth on two ends of a diameter of the sliding seat 31 are engaged with the two positioning portions 244 in the positioning recesses engaged with the positioning flange 311. In addition, at least one of the positing blocks 242 between the positioning recesses engaged with the positioning flange 311 is held in the space defined by the annular positioning flange 311. The inner surface of the annular positioning flange 311 abuts two curved side edges 243 of the at least one positioning block 242, and the outer surface 3112 of the annular positioning flange 311 abuts two curved sides 243 of two of the positioning blocks 242 which are adjacent to the positioning recesses engaged with the annular positioning flange 311. With the abutments between the inner surface and the outer surface 3112 of the positioning flange 311 and the curved side edges 243 of the positioning blocks 242, the positioning mount 30 can be held in place firmly relative to the track base 10.

Alternatively, when the annular positioning flange 311 of the positioning mount 30 is held in two of the positioning recesses, the inner surface and the outer surface 3112 of the positioning flange may be spaced from the adjacent curved side edges 243 of the adjacent positioning blocks 242 to form gaps therebetween. Consequently, even the positioning mount 30 is pushed relative to the track base 10, the positioning mount 30 can also be positioned at the desired position relative to the track base 10 due to the abutment of the inner surface or outer surface 3112 of the annular positioning flange 311 with the curved side edges 243 of the adjacent positioning blocks 242.

With such an arrangement, multiple sockets can be mounted detachably on extending elements of multiple positioning mounts 30 respectively. When each socket is attached onto the extending element 32 of a corresponding one of the positioning mounts 30, the protruding ball 321 on the extending element 32 is engaged with a cavity defined in the socket. Accordingly, the socket can be held in place on the extending element 32 of the positioning mount 30.

Figure 5:
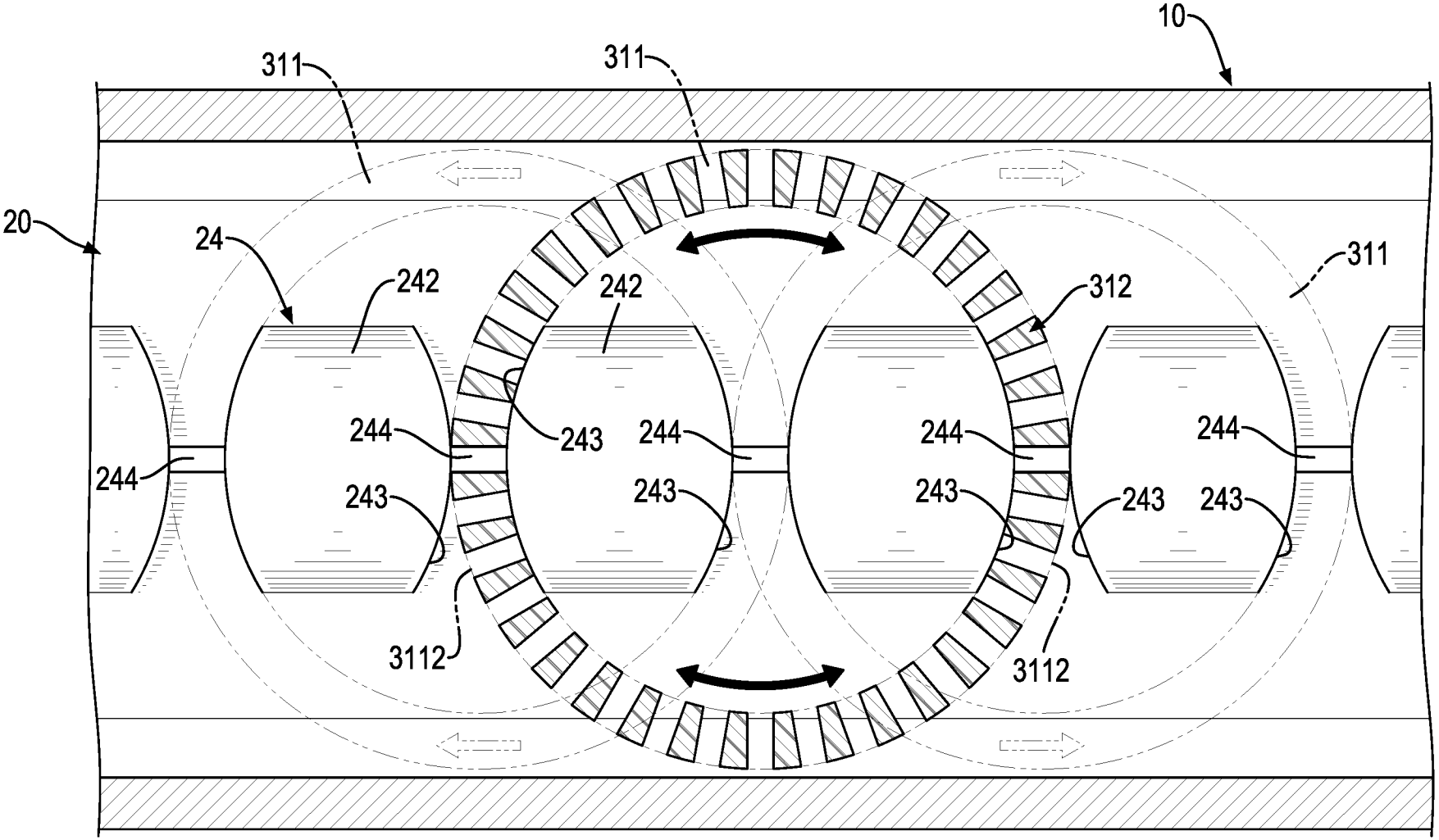
FIG. 5 is an operational cross sectional top view of the tool holding frame in FIG. 1.
Figure 6:
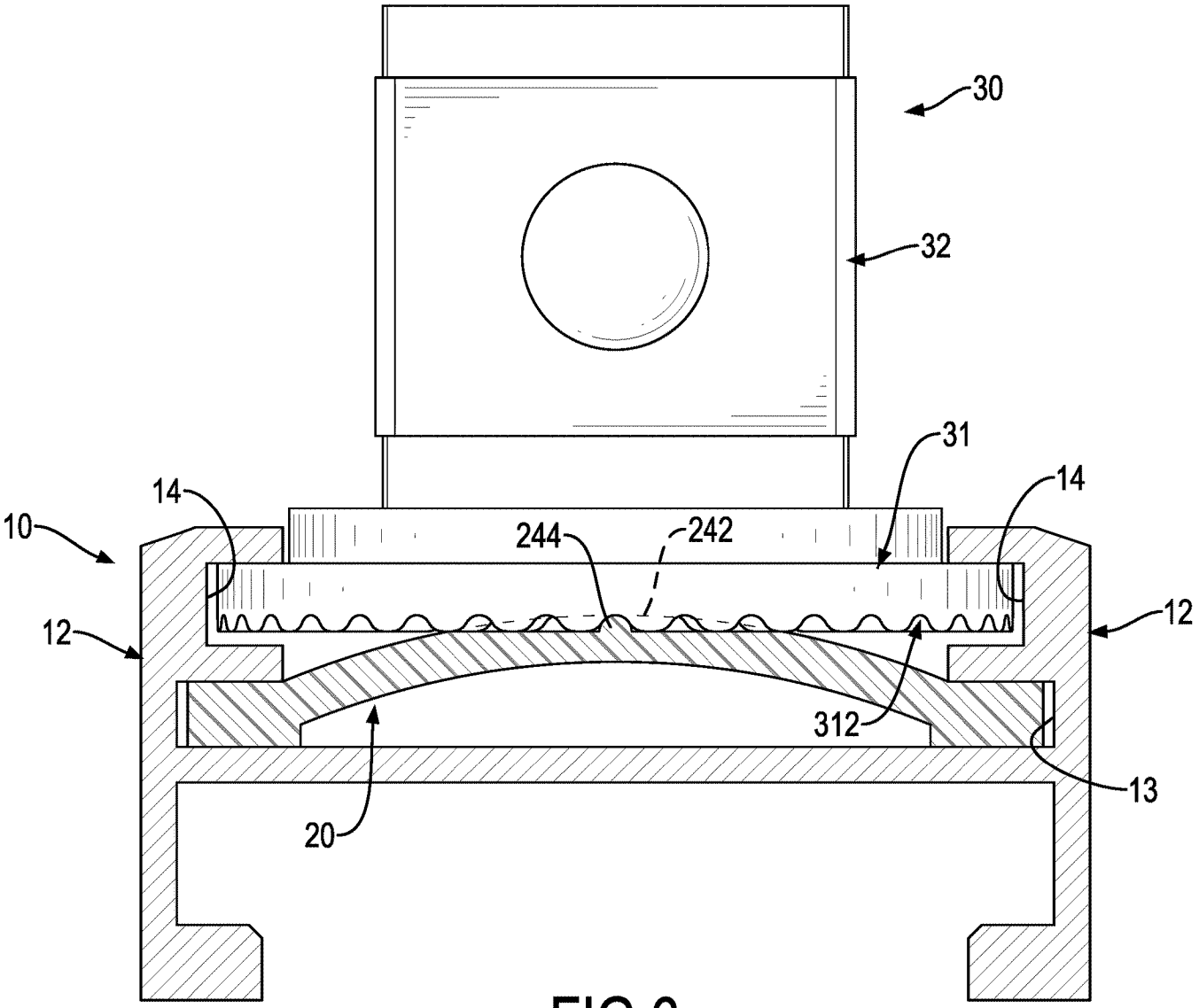
FIG. 6 is an end view in partial section of the tool holding frame in FIG. 1.
Figure 7:
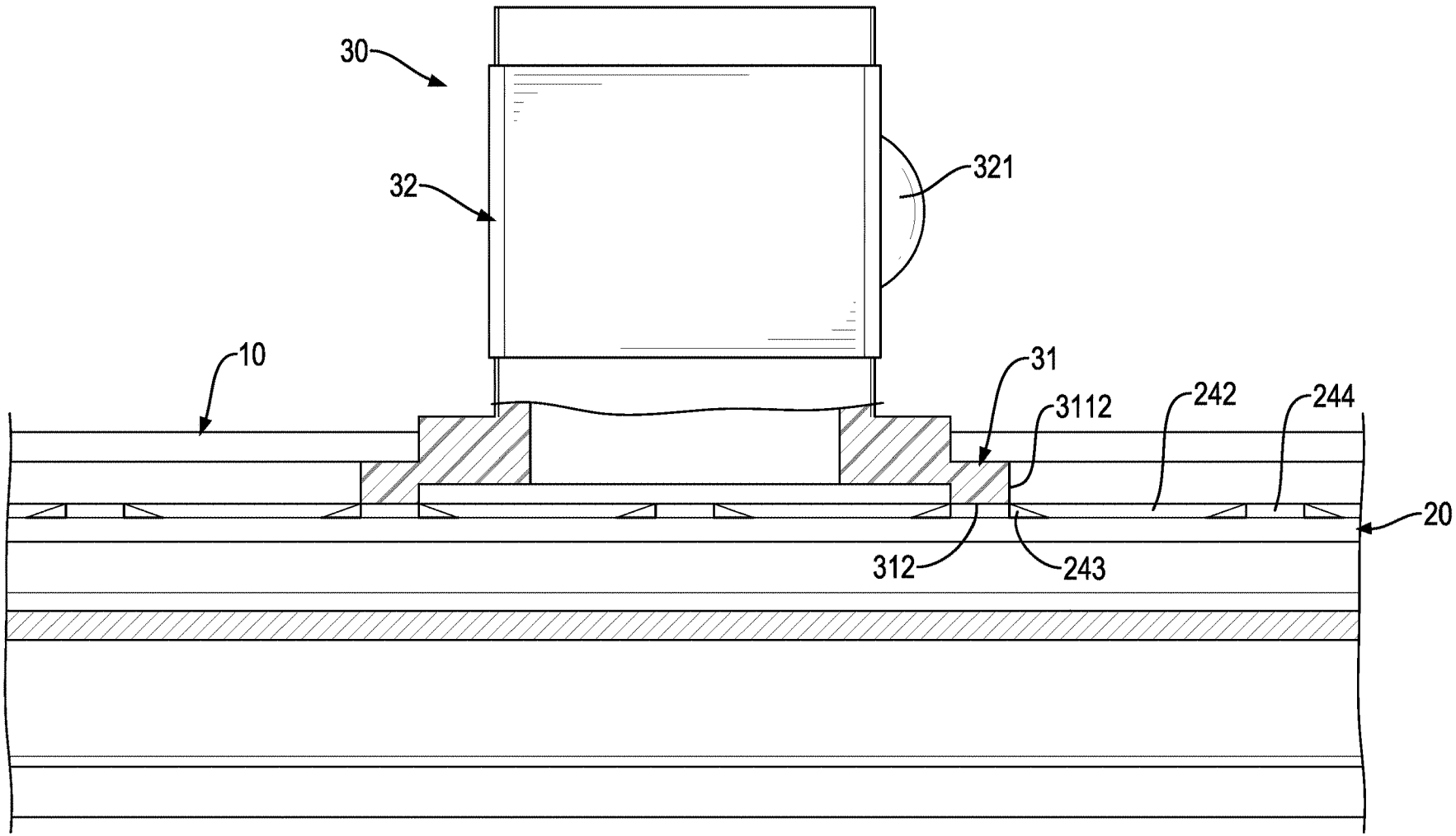
FIG. 7 is a side view in partial section of the tool holding frame in FIG. 1.

When numbers or signs on the sockets are not aligned at a same direction to face a user, the user may rotate the sockets in a clockwise or counterclockwise direction relative to the track base 10 to make the numbers or signs of the sockets 60 face the user. With reference to FIGS. 5 to 7, during the above-mentioned rotating process, the sliding seat 31 of the positioning mount 30 may be rotated with the socket relative to the positioning board 20 by the engagement between the extending element 32 of the positioning mount 30 and the socket. When the socket is rotated, the teeth of the second positioning segment 312 will be disengaged from the corresponding positioning portions 244 of the first positioning segment 24 due to the resilience of the sliding seat 31 of the positioning mount 30 or the positioning board 20. When the socket is rotated to a desired angle, another four teeth of the second positioning segment 312 will engage with the two positioning portions 244 of the first positioning segment 24. The positioning mount 30 can be firmly positioned at a specific angle relative to the track base 10 to make the numbers or signs on the sockets face the user, and the user can recognize and use the sockets easily.

In addition, each positioning portion 244 of the first positioning segment 24 may be a nipple or a knob. The second positioning segment 312 on the positioning flange 311 of each positioning mount 30 may comprise multiple cavities selectively engaged with the nipple or knob of the positioning portions 244. With the engagement between the first and second positioning segments, the positioning mount 30 can be held in a desired angle relative to the track base 10.

Figure 8:
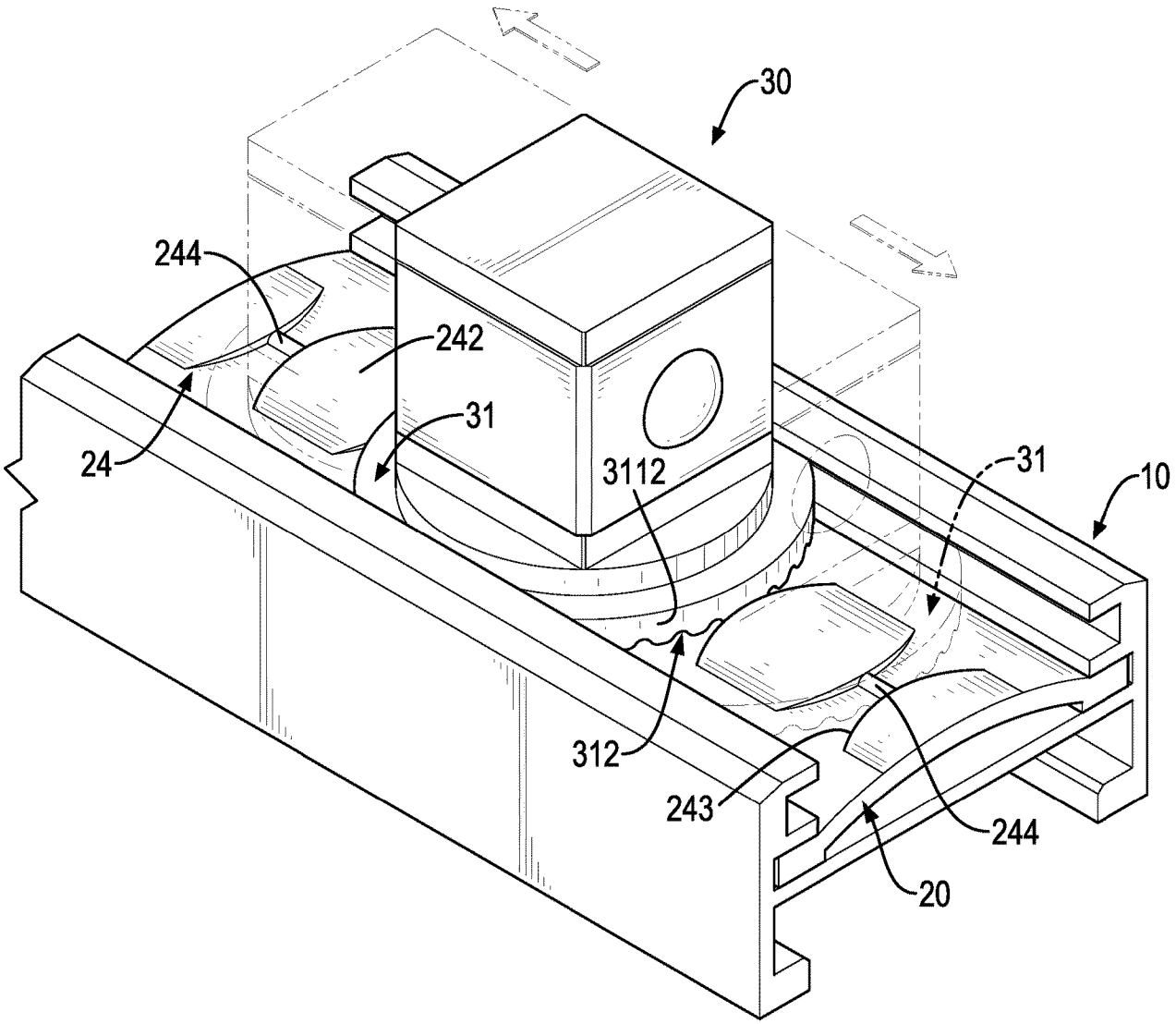
FIG. 8 is an operational perspective view of the tool holding frame in FIG. 1.
Figure 9:
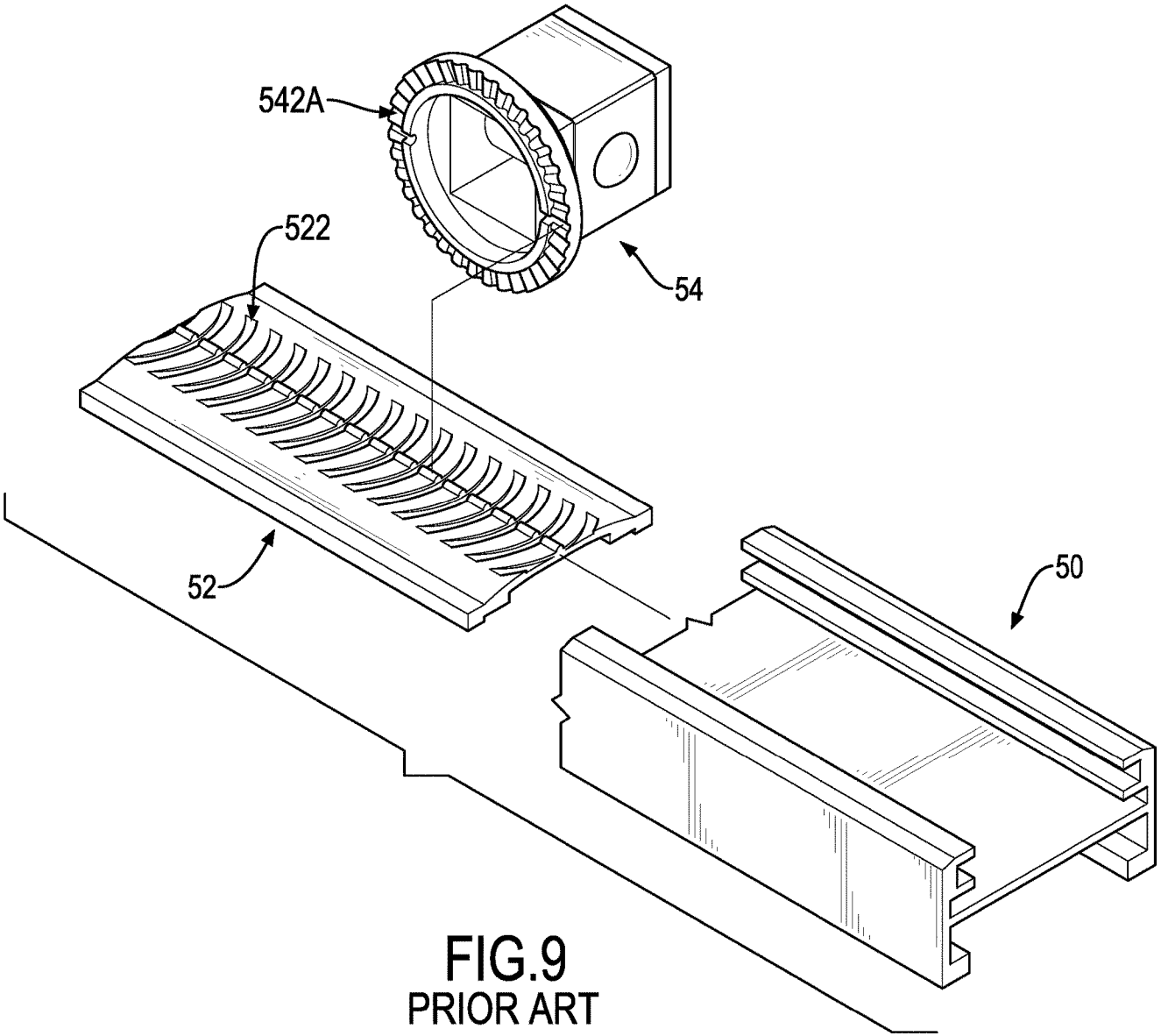
FIG.9 PRIOR ART
FIG. 9 is an exploded perspective view of a conventional socket holding frame.
Figure 10:
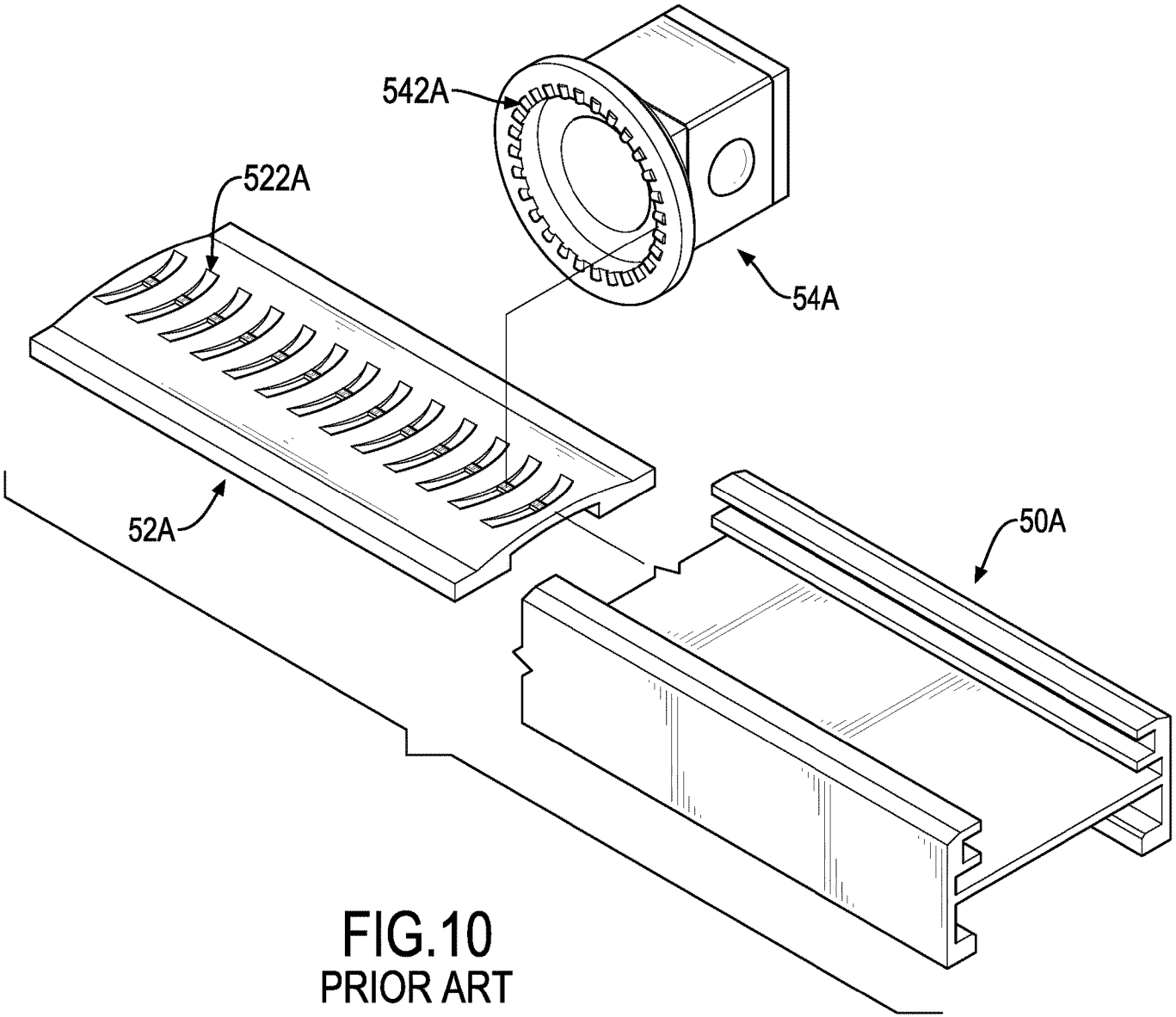
FIG.10 PRIOR ART
FIG. 10 is an exploded perspective view of another conventional socket holding frame.
Figure 11:
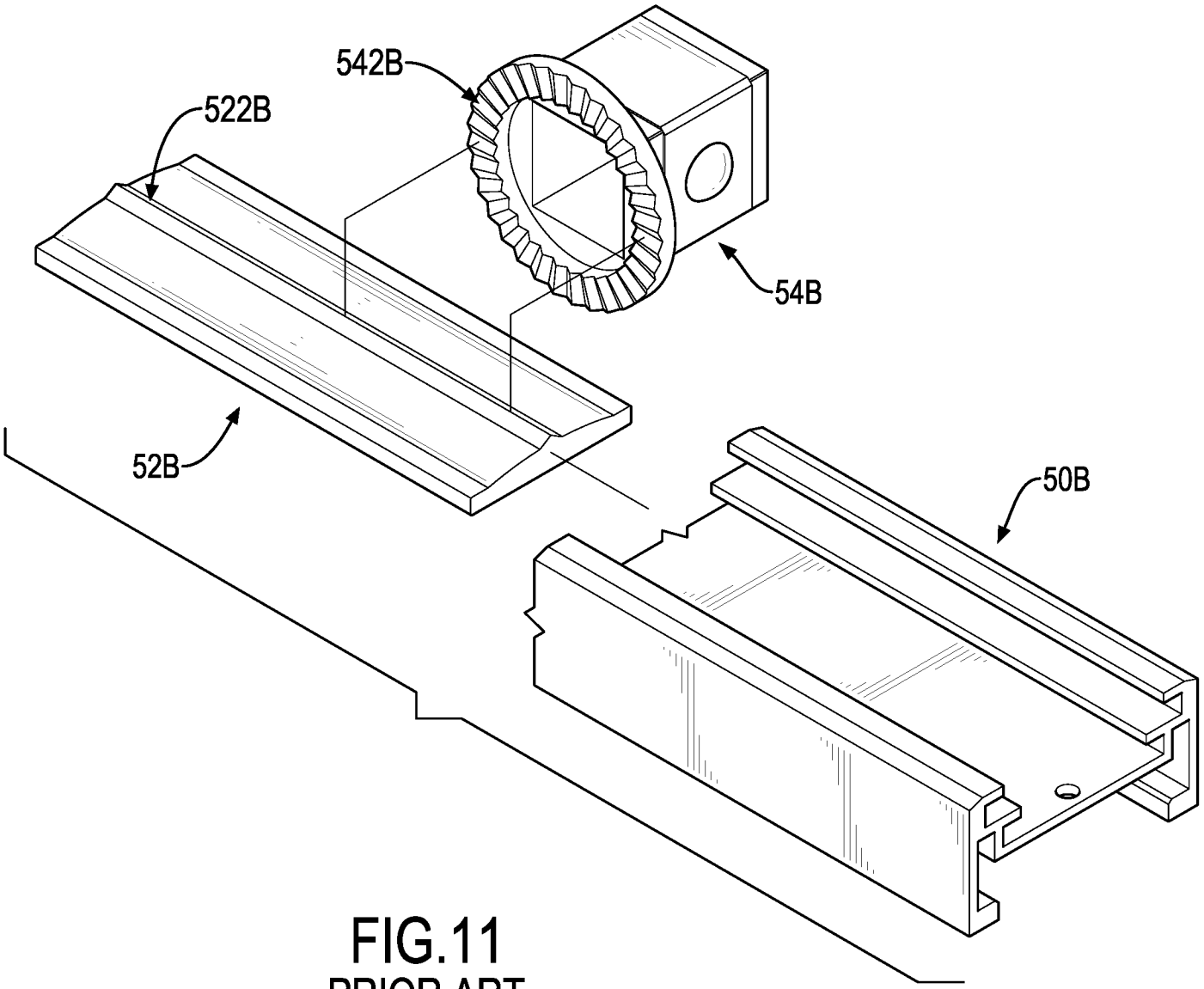
FIG.11 PRIOR ART
FIG. 11 is an exploded perspective view of further another conventional socket holding frame.

To change the position of the positioning mount 30, with reference to FIG. 8, the socket or the poisoning mount 30 can be moved along the track base 10 directly. The annular positioning flange 311 on the sliding seat 31 of the positioning mount 30 is disengaged from the positioning recesses due to the resilience of the sliding seat 31 or the positioning board 20, and the teeth of the second positioning segment 312 are also disengaged from the positioning portions 244 at the same time. In addition, the at least one positioning block will be escaped form the space formed by the annular positioning flange 311. Consequently, the positioning mount 30 can be slid rapidly along the track base 10 to a desired position to fit with different usage demands.

When the positioning mount 30 is moved to a desired position, the annular positioning flange 311 is engaged with another two of the positioning recesses in the positioning board 20, and the inner surface and the outer surface 3112 of the positioning flange 311 abut the curved side edges 243 of corresponding positioning blocks 242.

With the inner surface and the outer surface 3112 of the annular positioning flanges 311 abut the curved side edges 243 of the corresponding positioning blocks 242, a dual-movement directional positioning effect can be provided to the poisoning mount 30. Thus, the positioning mounts 30 can be held firmly relative to the track base and are not easily moved even when a large external force is applied to the tool holding frame.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A tool holding frame comprising:

a track base being an elongated seat and having two sliding channels defined respectively in two sides of the track base and each having an opening, and the openings of the two sliding channels facing each other;

a positioning board disposed on the track base and having a top surface;

a first positioning segment formed on the top surface of the positioning board and comprising multiple positioning blocks formed on and protruding from the top surface of the positioning board and arranged in a line at spaced intervals to define multiple positioning recesses respectively between the positioning blocks, and each positioning block having two curved side edges formed on two opposite sides of the positioning block; and multiple positioning portions formed on and protruding from the top surface of the positioning board and held respectively in the positioning recesses; and at least one positioning mount slidably and rotatably mounted on the track base, and each one of the at least one positioning mount having a sliding seat slidably and rotatably mounted in the sliding channels and having a bottom;

a top; and an annular positioning flange formed on and protruding downwardly from the bottom of the sliding seat, selectively engaged with two of the positioning recesses in the positioning board; and a second positioning segment formed on a bottom of the positioning flange and selectively engaged with two positioning portions held in the two positioning recesses engaged with the positioning flange; and an extending element formed on and protruding upwardly from the top of the sliding seat.

2. The tool holding frame as claimed in claim 1, wherein the annular positioning flange of each one of the at least one positioning mount has an inner surface selectively abutting two of the curved side edges of at least one of the positioning blocks located between the two positioning recesses engaged with the annular positioning flange; and an outer surface selectively abutting two of the curves side edges of the positioning blocks which are adjacent to the positioning recesses engaged with the annular positioning flange.

3. The tool holding frame as claimed in claim 2, wherein the track base comprises a bottom panel being elongated and having two sides; and two rails disposed respectively on the two sides of the bottom panel;

the two sliding channels are defined respectively in the rails;

each rail of the track base further has a positioning channel located below the sliding channel of the rail and having an opening;

the openings of the positioning channels of the two rails face each other; and the positioning board is mounted in the positioning channels in the rails of the track base.

4. The tool holding frame as claimed in claim 3, wherein the positioning board further comprises a bottom surface;

two rail bars formed on and protruding outwardly from the bottom surface of the positioning board respectively at two opposite sides of the positioning board and mounted respectively in the positioning channels of the rails of the track base; and a recess formed in the bottom surface of the positioning board at a middle of the positioning board, the recess being parallel with the opposite sides of the positioning board to form a space between the middle of the positioning board and the top surface of the bottom panel.

5. The tool holding frame as claimed in claim 4, wherein each positioning portion of the first positioning segment is a rib and has two ends connected respectively with two of the curved side edges of adjacent two of the positioning blocks.

6. The tool holding frame as claimed in claim 5, wherein the second positioning segment of each one of the at least one positioning mount comprises multiple teeth formed on and protruding from the bottom of the positioning flange of the positioning mount and arranged annularly at spaced intervals.

7. The tool holding frame as claimed in claim 1, wherein the track base comprises a bottom panel being elongated and having two sides; and two rails disposed respectively on the two sides of the bottom panel;

the two sliding channels are defined respectively in the rails;

each rail of the track base further has a positioning channel located below the sliding channel of the rail and having an opening;

the openings of the positioning channels of the two rails face each other; and the positioning board is mounted in the positioning channels in the rails of the track base.

8. The tool holding frame as claimed in claim 7, wherein the positioning board further comprises a bottom surface;

two rail bars formed on and protruding outwardly from the bottom surface of the positioning board respectively at two opposite sides of the positioning board and mounted respectively in the positioning channels of the rails of the track base; and a recess formed in the bottom surface of the positioning board at a middle of the positioning board, the recess being parallel with the opposite sides of the positioning board to form a space between the middle of the positioning board and the top surface of the bottom panel.

9. The tool holding frame as claimed in claim 8, wherein each positioning portion of the first positioning segment is a rib and has two ends connected respectively with two of the curved side edges of adjacent two of the positioning blocks.

10. The tool holding frame as claimed in claim 9, wherein the second positioning segment of each one of the at least one positioning mount comprises multiple teeth formed on and protruding from the bottom of the positioning flange of the positioning mount and arranged annularly at spaced intervals.

11. The tool holding frame as claimed in claim 2, wherein each positioning portion of the first positioning segment is a rib and has two ends connected respectively with two of the curved side edges of adjacent two of the positioning blocks.

12. The tool holding frame as claimed in claim 11, wherein the second positioning segment of each one of the at least one positioning mount comprises multiple teeth formed on and protruding from the bottom of the positioning flange of the positioning mount and arranged annularly at spaced intervals.

13. The tool holding frame as claimed in claim 1, wherein each positioning portion of the first positioning segment is a rib and has two ends connected respectively with two of the curved side edges of adjacent two of the positioning blocks.

14. The tool holding frame as claimed in claim 13, wherein the second positioning segment of each one of the at least one positioning mount comprises multiple teeth formed on and protruding from the bottom of the positioning flange of the positioning mount and arranged annularly at spaced intervals.

* * * * *